US007091410B2

(12) United States Patent
Ito et al.

(10) Patent No.: US 7,091,410 B2
(45) Date of Patent: Aug. 15, 2006

(54) APPARATUS AND COMPUTER PROGRAM FOR PROVIDING ARPEGGIO PATTERNS

(75) Inventors: Yoshihisa Ito, Hamamatsu (JP); Yoichiro Ogai, Shizuoka-ken (JP); Kensuke Ide, Hamamatsu (JP)

(73) Assignee: Yamaha Corporation (JP)

( * ) Notice: Subject to any disclaimer, the term of this patent is extended or adjusted under 35 U.S.C. 154(b) by 114 days.

(21) Appl. No.: 10/869,820

(22) Filed: Jun. 16, 2004

(65) Prior Publication Data

US 2005/0016366 A1 Jan. 27, 2005

(30) Foreign Application Priority Data

Jun. 19, 2003 (JP) ..... 2003-174430

(51) Int. Cl.
*G10H 1/28* (2006.01)
*G10H 7/00* (2006.01)

(52) U.S. Cl. ..... 84/638; 84/659

(58) Field of Classification Search ..... 84/622, 84/659, 638

See application file for complete search history.

(56) References Cited

U.S. PATENT DOCUMENTS 4,444,081 A * 4/1984 Jones et al. ..... 84/638
4,619,176 A * 10/1986 Isii ..... 84/610
5,973,254 A * 10/1999 Yamamoto ..... 84/609
6,051,771 A * 4/2000 Iizuka ..... 84/622
6,919,502 B1 * 7/2005 Yamamoto ..... 84/622

FOREIGN PATENT DOCUMENTS

JP 10-288988 10/1998
JP 2001-22354 A 1/2001
JP 3277844 B2 2/2002

* cited by examiner

*Primary Examiner*—Jeffrey W Donels
(74) *Attorney, Agent, or Firm*—Rossi, Kimms & McDowell LLP

(57) ABSTRACT

Various arpeggio patterns are provided for an automatic arpeggio performance in an electronic musical apparatus, in which arpeggio notes are sounded in various timbres and appropriate arpeggio types are selected for the respective timbres. For each of a plurality of timbres, plural available arpeggio types are prepared which are appropriate for the timbre, and are assigned to plural arpeggio type selecting buttons, respectively. According to the manipulation of an arpeggio type selecting button, the assigned type is selected and the arpeggio pattern data of the selected arpeggio type are outputted for the successive sounding of the notes as an arpeggio. The assignment of the arpeggio types to the selecting buttons are alterable by the user.

11 Claims, 7 Drawing Sheets

Functional Configuration

*Fig. 1* Functional Configuration

*Fig.2*

Timbre-Dependent Available Arpeggio Types as Assigned to Arpeggio Type Selecting Buttons and Registered in Assignment Registering Unit

| Registration # of Arpeggio Type Selecting Button 3`1-3`5 | 1 ↓ | 2 ↓ | 3 ↓ | 4 ↓ | 5 ↓ |
|---|---|---|---|---|---|
| Timbre #1 → | Type #1 | Type #2 | Type #3 | Unregistered | Unregistered |
| Timbre #2 → | Type #1 | Type #11 | Type #15 | Type #12 | Type #13 |
| Timbre #3 → | Unregistered | Type #23 | Unregistered | Unregistered | Unregistered |

*Fig. 3* Screen Display
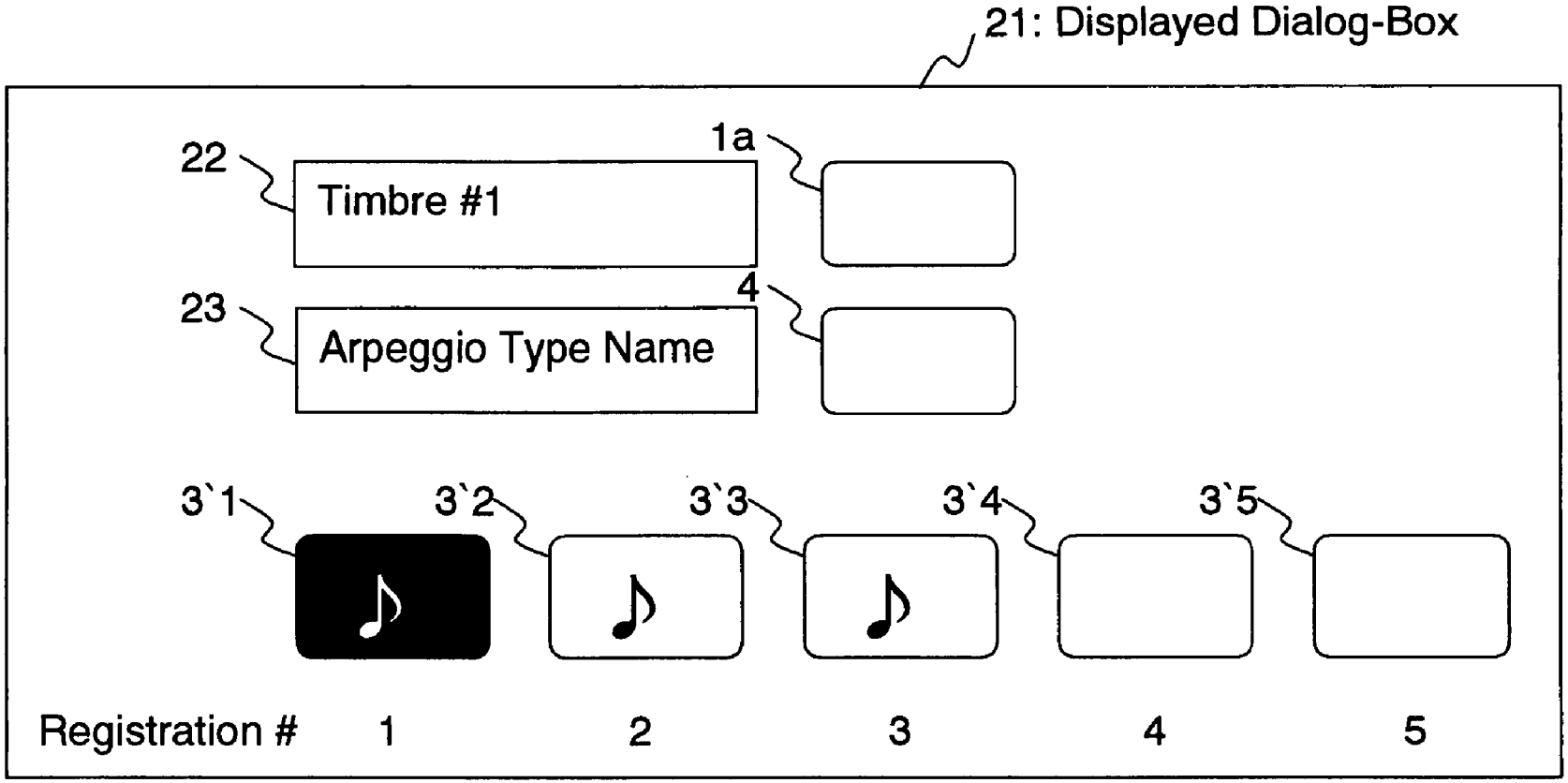

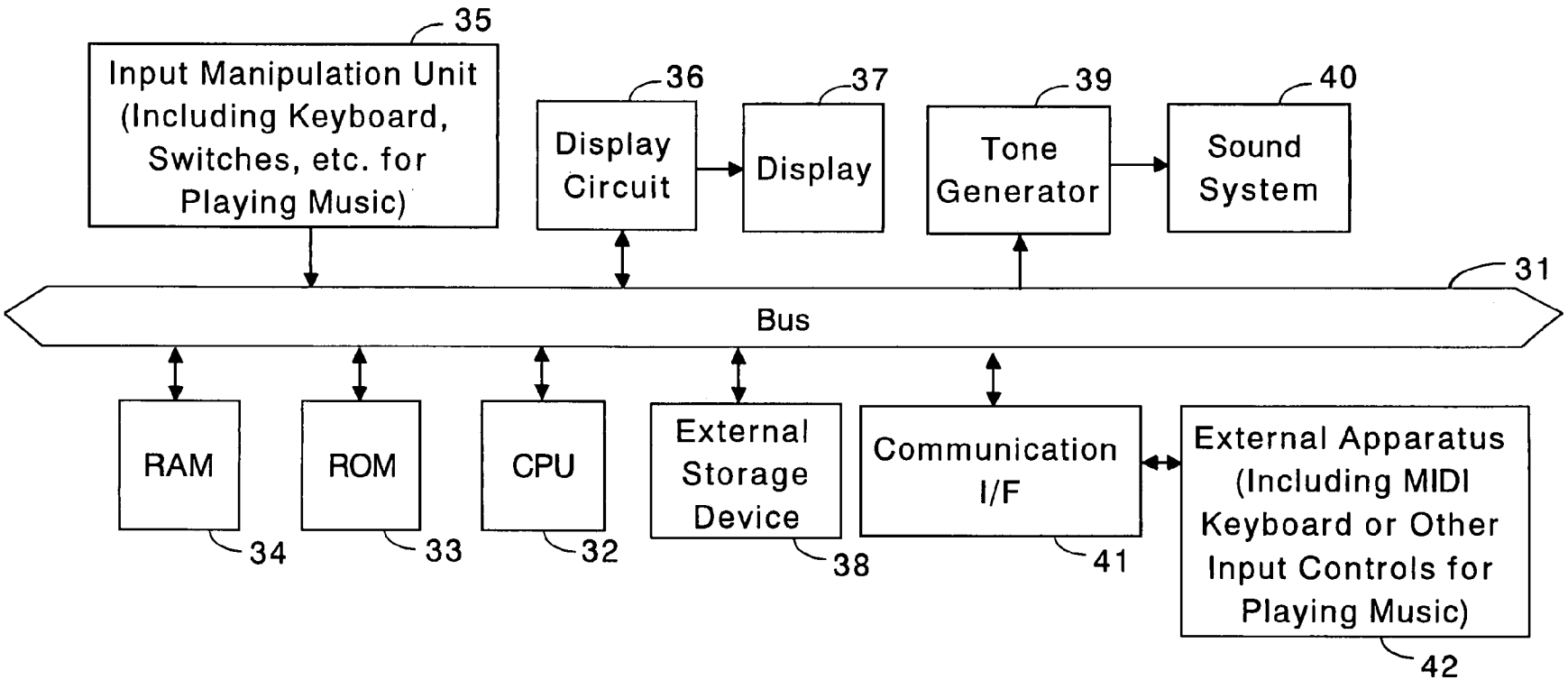
*Fig. 4* Hardware Configuration

*Fig. 5a* Processing Flow (Part 1)
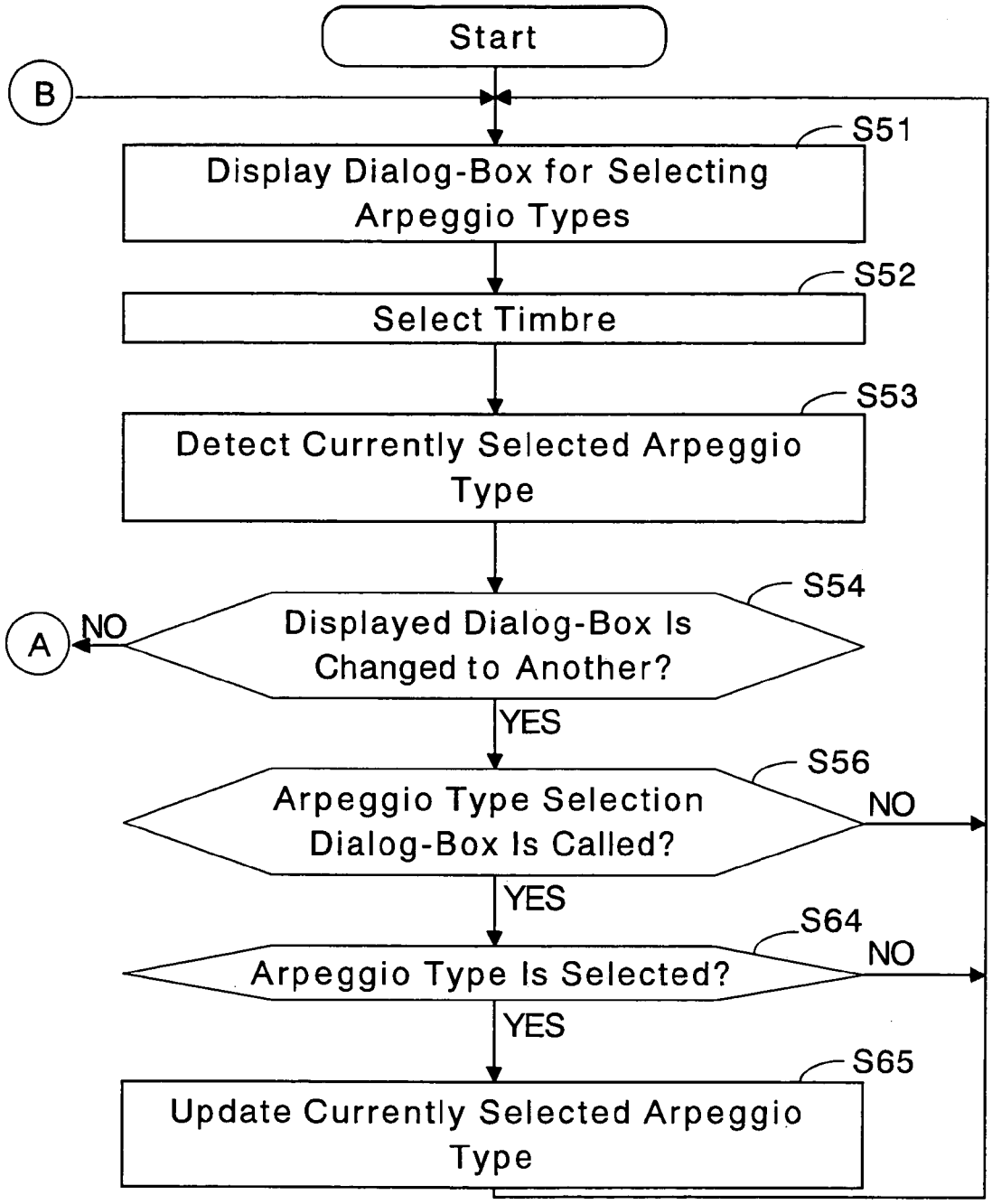

*Fig. 5b* Processing Flow (Part 2)
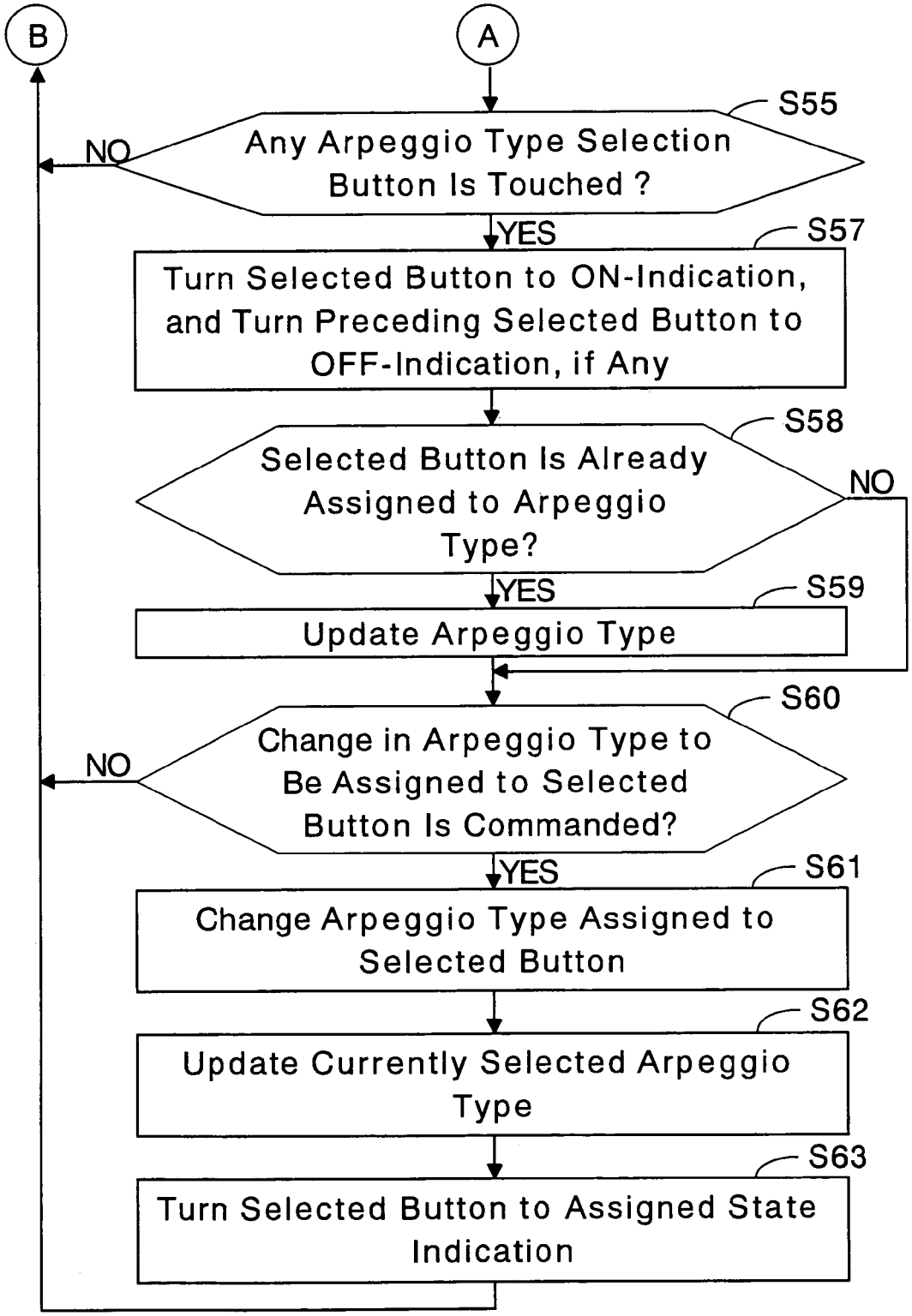

*Fig. 6* Contents in Storing Unit
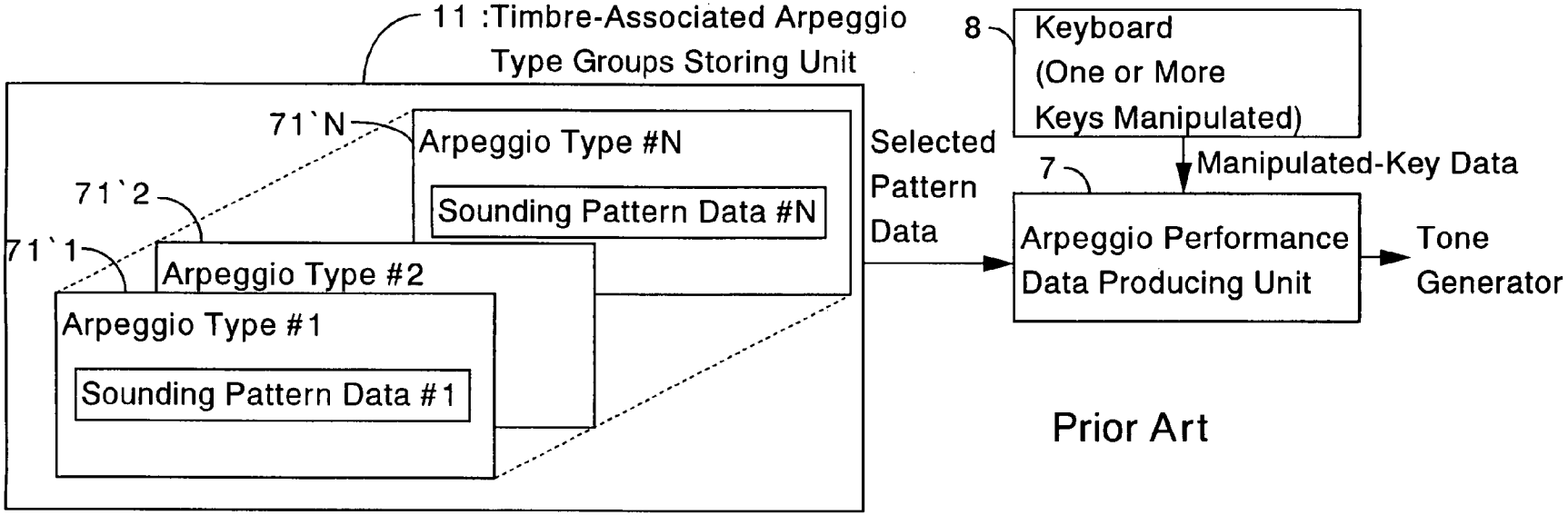

APPARATUS AND COMPUTER PROGRAM FOR PROVIDING ARPEGGIO PATTERNS

TECHNICAL FIELD

The present invention relates to an apparatus and a computer program for providing arpeggio patterns, and more particularly to an apparatus and a computer program for providing arpeggio pattern data to be used for an automatic arpeggio performance in an electronic musical apparatus such as a music synthesizer and a computer-aided music player, in which arpeggio notes are sounded in various timbres or tone colors and appropriate arpeggio types are selected for the respective timbres.

BACKGROUND INFORMATION

A separate apparatus or a functional unit in a musical apparatus such as a music synthesizer which realizes an arpeggio performance based on key depressions is known in the art and is called an "arpeggiator." See, for example, unexamined Japanese patent publication No. 2001-022354. In such an arpeggiator, a plurality of key orders (note sounding orders) and sounding time points of the respective keys, constituting, in pairs, an alignment of notes to be sounded, namely, an arpeggio pattern, are stored in an arpeggio pattern memory. The sounding time points represent the starting time points of the respective notes to be sounded in terms of absolute time from the beginning of the sounding pattern or in terms of relative time from the time point of the preceding note. The user depresses the keys of the notes for an arpeggio in a predetermined keyboard region, and the note numbers (i.e. note pitches) of the depressed keys are obtained accordingly. The respective note numbers are assigned to the above-mentioned respective key orders (note orders) according to a predetermined rule, such as in the ascending order of the note pitches. For example, where keys of C4, E4, G4 and C5 are depressed, the C4 key is assigned to the 1st lowest key, the E4 key is assigned to the 2nd lowest key, the G4 key is assigned to the 3rd lowest key and the C5 key is assigned to the 4th lowest key in the arpeggio pattern. At each sounding time point in the arpeggio pattern, each note number assigned to each key order (note sounding order) causes the sounding data of each note to be supplied to the tone generator, as long as the keys are kept depressed for an arpeggio performance.

FIG. 6 is a block diagram illustrating the functional configuration of an example of how arpeggio patterns are selected according to a conventional apparatus. In an electronic musical apparatus such as a music synthesizer, a timbre-associated arpeggio type groups storing unit 11 stores a plurality of arpeggio pattern data sets 71'1 through 71'N of different arpeggio types in the form of files containing sounding pattern data #1 through #N. There are various arpeggio types including up octave, down octave, up-and-down octave, and random. The user calls an arpeggio type selecting window (not shown) through a selection menu, selects an arpeggio type (e.g. arpeggio type #1) to use the arpeggio pattern data 71'1. The selected pattern data set is supplied to an arpeggio performance data producing unit 7. As the user manipulates one or more keys on a keyboard 8 to designates one or more note numbers for an arpeggio, the arpeggio performance data producing unit 7 produces arpeggio performance data containing data of a successive alignment of notes to constitute an arpeggio based on the selected pattern data from the storing unit 11 and the manipulated key data from the keyboard 8, and outputs the arpeggio performance data to a tone generator (not shown) to generate the tones of the arpeggio constituting notes.

The sounding pattern data set may include data relating to "gate times" (tone sounding durations), "velocities" (tone sounding intensity) and "octave shifts" in addition to the "key order" (note sounding order) at the respective "sounding time points." With such additional data, every tone will be generated in a length defined by the gate time and in an intensity defined by the velocity, and in a pitch as shifted (up or down) by an octave or actives from the note number which is designated by the keyboard 8. The tempo (i.e. speed) of playing back the performance data (i.e. generating tones according to the data) can be arbitrarily set by the user. Alternatively, the tempo may be automatically controlled by detecting the tempo of the actual performance by the user.

While the above description is about the arpeggio pattern data which are arbitrarily selected by the user or player, the arpeggio pattern data may be automatically selected depending on a timbre or tone color for the arpeggio tones as designated by the user. In the latter situation, the arpeggio pattern data sets 71'1 through 71'N are prepared in association with the timbres in which the arpeggio tones are to be generated. For example, types #1 through #10 are for timbre #1, types #11 through #20 are for timbre #2, types #21 through #30 are for timber #3, and so forth. The timbre allotted to each arpeggio pattern data set (e.g. 71'1) may be easily identified by placing a timbre ID number in the header portion of the file (arpeggio pattern data set). Alternatively, the arpeggio pattern data sets 71'1 through 71'N may be stored in the storage unit 11 separately according to the timbres with which the respective arpeggio pattern data sets are associated. See, for example, registered Japanese patent No. 3,277,844 (FIG. 5 and paragraphs 0028–0031).

When the user designates a timbre, one of the arpeggio pattern data sets prepared for the designated timbre is selected from among the arpeggio pattern data sets stored separately for separate timbres. On such an apparatus, the user will have to merely manipulate the "arpeggio performance designating switch" when the user starts an arpeggio performance in a certain intended timbre, so that the arpeggio pattern data of the arpeggio type prepared and registered for the intended timbre will be available. In another situation, however, the user may want to use an arpeggio type which is not previously associated with the intended timbre or an arpeggio type which is associated with the intended timbre but is not previously registered for that timbre, simply by manipulating the "arpeggio performance designating switch." In such a situation, the user would have to change from the timber setting menu to an arpeggio type selection menu window, find out the intended arpeggio type in the exhibited window, and select the same, which operation is very troublesome.

SUMMARY OF THE INVENTION

It is, therefore, a primary object of the present invention to solve the drawbacks with the conventional apparatus, and to provide a novel type of apparatus and computer program for providing arpeggio patterns, in which a plurality of arpeggio types are made available with respect to at least one timbres for providing an arpeggio pattern in realizing an arpeggio performance, and further in which the manipulation is easily and efficiently done for selecting an arpeggio type from among the plurality of arpeggio types which are rendered available in connection with the designated timbre.

According to the present invention, the object is accomplished by providing an apparatus for providing arpeggio patterns comprising: a timbre designating device which designates a timbre in which arpeggio notes are to be sounded; a timbre-dependent arpeggio type output device which presents one or more available arpeggio types depending on the timbre designated by the timbre designating device, wherein a plurality of arpeggio types are made available with respect to at least one timbres designated by the timbre designating device, and at least one arpeggio types are outputted from among the plurality of arpeggio types; and an arpeggio pattern data output device which outputs arpeggio pattern data of the arpeggio types outputted by the timbre-dependent arpeggio type output device. Thus, as the user designates a timbre in which an arpeggio performance is to be given, a plurality of arpeggio types are made available with respect to the designated timbre, and an arpeggio pattern data set will be provided according to at least one arpeggio type out of the plurality of available arpeggio types. There will usually be outputted one arpeggio type, but plural arpeggio types may be outputted instead, whereby the plural arpeggio patterns are supplied to the tone generator, which in turn will generates musical tones performing different arpeggios mixed together.

In an aspect of the present invention, the arpeggio types are prepared in association with the respective timbres, and the timbre-dependent arpeggio type output device availably presents part or all of the one or more arpeggio types prepared in association with respective timbres depending on the timbre designated by the timbre designating device. As the arpeggio types which are made available are selected from among the arpeggio types which are prepared in association with the timbres to be designated by the timbre selecting device, the selected arpeggio type is adequate for the designated timbre.

In a further aspect of the present invention, the timbre-dependent arpeggio type output device includes a timbre-dependent available arpeggio type presenting device and an arpeggio type selecting device, wherein the timbre-dependent arpeggio type presenting device is to present one or more available arpeggio types depending on the timbre as designated by the timbre designating device so that a plurality of arpeggio types are made available with respect to at least one of the timbres as designated by the timbre designating device, and is to assign the one or more available arpeggio types respectively to one or more arpeggio type selecting controls; and wherein the arpeggio type selecting device is to select, in response to manipulation of one of the one or more arpeggio type selecting controls and by means of the timbre-dependent available arpeggio type presenting device, an available arpeggio type which is assigned to the manipulated one of the selecting controls, and to output the selected arpeggio type. When a timbre is designated, a plurality of arpeggio types are presented for the designated timbre and are assigned to a plurality of selecting controls, and thus an intended arpeggio type can be easily and efficiently selected by the manipulation of the selecting control. This is very preferable particularly when the arpeggio types are to be changed in the midst of the music performance.

The timbre-dependent available arpeggio type presenting device may employ an arpeggio type assignment registration device so that the available arpeggio types for the designated timbre are assigned to the respective selecting controls. The arpeggio type assignment registration device stores available arpeggio types to be assigned to the selecting controls with respect to each of the timbres. The arpeggio types may be stored in the form of individual data, or may be contained in the operating program stored in the storage device.

In a still further aspect of the present invention, the apparatus for providing arpeggio patterns further comprises a display device and a display control device, wherein the display control device controls the display device to display the arpeggio type selecting controls on the display device in such a way that the arpeggio type selecting controls to each of which an available arpeggio type is assigned and the arpeggio type selecting controls to each of which an available arpeggio type is not assigned are displayed in different fashions. Thus, the user can easily distinguish the selecting control to which an arpeggio type is assigned and the selecting control to which an arpeggio type is not assigned among a plurality of selecting controls. The number and the kinds of arpeggio types to be made available may be different depending on timbres or preferences of the users. Alternatively, the number of selecting controls may be fixed, and still the user can easily recognize a selecting control to which an available arpeggio type is assigned.

In a still further aspect of the present invention, the apparatus for providing arpeggio patterns further comprises a display device and a display control device, wherein the display control device controls the display device to display the arpeggio type selecting controls on the display device in such a way that the manipulated one of the arpeggio type selecting controls and the non-manipulated ones of the arpeggio type selecting controls are displayed in different fashions. Thus, the user can easily recognize the manipulated one among the selecting controls.

In a still further aspect of the present invention, the arpeggio type selecting device is so designed to select and output an initial default arpeggio type by randomly selecting one from among the available arpeggio types presented by the timbre-dependent available arpeggio type presenting device with respect to the at least one timbres designated by the timbre designating device. As the initial default arpeggio type is randomly selected, the arpeggio performance will be a surprise to the user. And as the selection is from among the availably presented arpeggio types, the user will not feel a sense of strangeness in the performance.

In a still further aspect of the present invention, the timbre-dependent available arpeggio type presenting device alters available arpeggio types as presented in association with the timbre designated by the timbre designating device, according to the manipulation by the user for altering the designation of the timbre.

In a still further aspect of the present invention, the timbre-dependent available arpeggio type presenting device alters assignment of the available arpeggio types in association with the timbre as designated by the timbre designating device to the respective arpeggio type selecting controls, according to the manipulation by the user for altering the assignment of the available arpeggio types. Thus, the user can alter the assignment of the arpeggio types to the selecting controls in accordance with the user's preference.

According to the present invention, the object is further accomplished by providing a computer program for providing arpeggio patterns containing program instructions executable by a computer, the program causing the computer to execute: a timbre designating step for designating a timbre in which arpeggio notes are to be sounded; a timbre-dependent arpeggio type outputting step for presenting one or more available arpeggio types depending on the timbre designated by the timbre designating step, wherein a plurality of arpeggio types are made available with respect to at least one timbres designated by the timbre designating step, and for outputting at least one arpeggio types from among the plurality of arpeggio types; and an arpeggio pattern data outputting step for outputting arpeggio pattern data of the arpeggio types outputted by the timbre-dependent arpeggio type output device.

In a still further aspect of the present invention, the various aspects as mentioned above may be realized by a computer program which executes the steps of performing the functions of the respective devices. For, example, the step of outputting the timbre-dependent arpeggio types may include a sub-step of presenting available arpeggio types depending on the timbres and a sub-step of selecting an arpeggio type from among such presented available arpeggio types.

As will be apparent from the description herein later, some of the structural element devices of the present invention are structured by means of a hardware circuits, while some are configured by a computer system performing the assigned functions according to the associated programs. The former may of course be configured by a computer system and the latter may of course be hardware structured discrete devices. Therefore, a hardware-structured device performing a certain function and a computer-configured arrangement performing the same function should be considered a same-named device or an equivalent to each other.

BRIEF DESCRIPTION OF THE DRAWINGS

For a better understanding of the present invention, and to show how the same may be practiced and will work, reference will now be made, by way of example, to the accompanying drawings, in which:

FIG. 2 is a chart showing the assignment of the timbre-dependent available arpeggio types to the arpeggio type selecting buttons as registered in the assignment registering unit in an embodiment of the present invention;

FIG. 3 is a chart depicting an example of the dialog-box displayed on the display screen for assigning and selecting arpeggio types;

FIG. 4 is a block diagram illustrating the hardware configuration of an embodiment of an apparatus for providing arpeggio patterns according to the present invention;

FIGS. 5*a* and 5*b* are, in combination, a flow chart describing the process steps for providing arpeggio patterns according to the present invention; and FIG. 6 is a block diagram illustrating the functional configuration of an example of how arpeggio patterns are selected according to a conventional apparatus.

DETAILED DESCRIPTION OF EMBODIMENTS OF THE INVENTION

Figure 1:
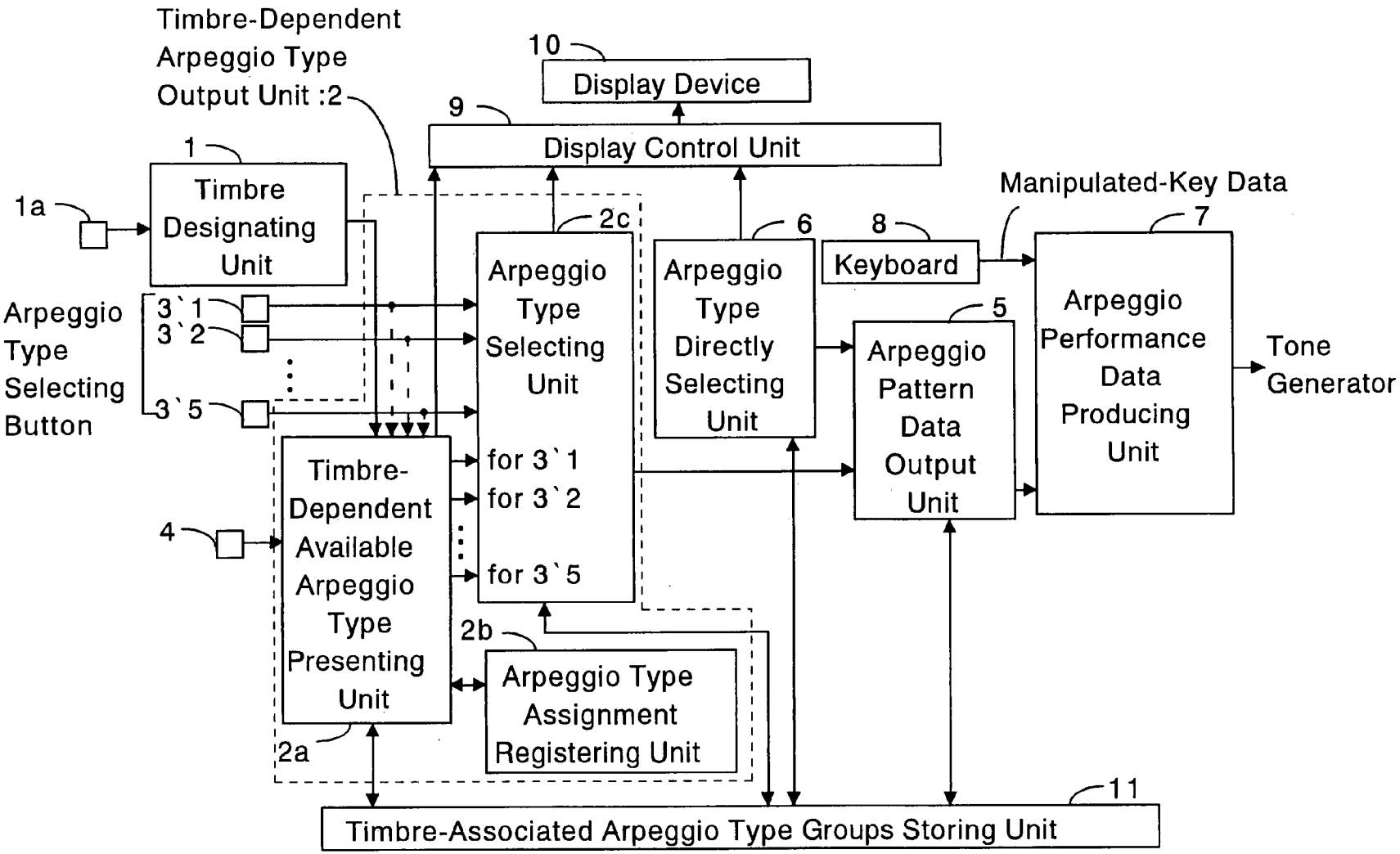
FIG. 1 is a block diagram illustrating the functional configuration of an embodiment of an apparatus for providing arpeggio patterns according to the present invention.

Herein below will be described an embodiment of the present invention with reference to accompanying drawings. FIG. 1 shows a block diagram illustrating the functional configuration of an embodiment of an apparatus for providing arpeggio patterns according to the present invention. In the present embodiment, the operations of the functional blocks are conducted by the associated computer programs rather than by dedicated hardware circuits. The functional blocks may, of course, be constructed by hardware circuits.

A timbre designating unit 1 is to designate a timbre or tone color in which an arpeggio performance is to be given, and has a timbre designating control (e.g. switch) 1*a* for the user to manipulate to designate an intended timbre for the arpeggio performance. A timbre-associated arpeggio type groups storing unit 11 stores arpeggio types in groups respectively for different timbres, each group containing one or more arpeggio types which are adequate for the allotted timbre.

A timbre-dependent arpeggio type output unit 2 is to select and output an arpeggio type (i.e. arpeggio type indicative signal) which represents an arpeggio type adequate for the designated timbre. The timbre-dependent arpeggio type output unit 2 comprises a timbre-dependent available arpeggio type presenting unit 2*a*, an arpeggio type assignment registration unit 2*b* and an arpeggio type selecting unit 2*c*. The timbre-dependent available arpeggio type presenting unit 2*a* fetches one or more arpeggio types as grouped for the designated timber from the timbre-associated arpeggio type groups storing unit 11, and presents the fetched one or more arpeggio types to be available for the designated timbre. Thus, a plurality of arpeggio types are made available for at least one of the timbres designated by the timbre designating unit 1. The presented one or more available arpeggio types are assigned to one or more arpeggio type selecting controls (e.g. buttons) 3'1 through 3'5. For example, arpeggio type #1 is assigned to the selecting button 3'1, arpeggio type #2 to the selecting button 3'2, and so forth. The assigned one or more arpeggio types are outputted to the arpeggio type selecting unit 2*c* in correspondence to the assigned arpeggio type selecting controls (e.g. buttons) 3'1 through 3'5 for the timbre designated by the timbre designating unit 1.

The arpeggio type selecting unit 2*c* outputs the arpeggio type assigned to the manipulated one of the selecting controls 3'1 through 3'5 by selecting one from among the available arpeggio types supplied from the timbre-dependent available arpeggio type presenting unit 2*a*, and supplies the selected arpeggio type to an arpeggio pattern data output unit 5.

Using the arpeggio type number as a reference key, the arpeggio pattern data output unit 5 refers to the timbre-associated arpeggio type groups storing unit 11 for a set of arpeggio pattern data which meets the selected arpeggio type, and provides thus determined set of arpeggio pattern data which is of the arpeggio type as nominated by the arpeggio type selecting unit 2*c*. The thus provided arpeggio pattern data set is supplied to an arpeggio performance data producing unit 8. The arpeggio pattern data sets corresponds to the arpeggio pattern data sets 71'1 through 71'N shown in FIG. 6

The arpeggio performance data producing unit 7 produces an arpeggio performance data set based on the arpeggio pattern data set from the arpeggio pattern data output unit 5 or manipulated-key data supplied from a keyboard 8 according to the user's playing music. An arpeggio type directly selecting unit 6 displays a menu window for the selection of arpeggio pattern data for the user to directly find and select a desired arpeggio type.

The timbre-dependent arpeggio type output unit 2 uses the arpeggio type assignment registering unit 2*b* in determining one or more arpeggio type selecting controls to which one or more arpeggio types are respectively assigned in accordance with the timbre designated by the timbre designating unit 1.

FIG. 2 is a chart showing an example of the contents of the arpeggio type assignment registering unit 2*b*. The assignment registering unit 2*b* stores the data of the arpeggio types which are available for the respective timbres and which are assigned to the respective selecting buttons (controls). For example, the arpeggio types are made available for timbers #1, #2 and #3 and are assigned to arpeggio type selecting buttons 3'1 through 3'5. There are five cells to store arpeggio type numbers corresponding to the number of arpeggio type selecting buttons 3'1 through 3'5 for each of the timbres #1 through #3. Each of the columns of the cells is given a registration number (#1, - - - #5). For each timbre, there are maximum of five arpeggio types made available and assigned.

With respect to timbre #1, for example, three available arpeggio types #1 through #3 are respectively assigned to the arpeggio type selecting buttons 3'1 through 3'3, while no arpeggio type is assigned to the buttons 3'4 and 3'5, remaining unregistered. With respect to timbre #2, arpeggio types #1, #11, #15, #12 and #13 are assigned to the arpeggio type selecting buttons 3'1 through 3'5, respectively. With respect to timbre #3, only arpeggio type #23 is assigned to the arpeggio type selecting button 3'2. There may be a situation where only one arpeggio type is made available and assigned to the selecting button as exemplified with respect to timbre #3, or there may be another situation where no arpeggio type is made available and assigned to the selecting button, depending on the timbres.

As described about a prior art apparatus with reference to FIG. 6, where all the arpeggio types are inherently prepared in association with the respective timbres, the timbre-dependent available arpeggio type presenting unit 2*a* may simply refer to the arpeggio type group in the storing unit 11 which group is associated with the timbre designated by the timbre designating unit 1, and render part of or all of the arpeggio types from the group available. Thus, the selected arpeggio type will be adequate for the intended timbre, as the arpeggio types made available are all from the arpeggio type group associated with the timbre which is designated by the timbre designating unit 1. Needless to say, all of the arpeggio types which are inherently associated with the intended timbre may not necessarily be made available, but a part of arpeggio types may be made available depending on the number of arpeggio type selecting buttons 3'1 through 3'5 or the preference of the user.

In the prior art embodiment including FIG. 6, the arpeggio types used to be fixedly associated with the timbres in a manner, for example, that arpeggio types #1 through #10 are for timbre #1, arpeggio types #11 through #20 are for timbre #2 and arpeggio types #21 through #30 are for timbre #3. But in this invention, the timbre-dependent available arpeggio type presenting unit 2*a* may make arpeggio types which are not inherently associated with a certain designated timbre available for this designated timbre. In the example of FIG. 2, arpeggio type #23 is made available for timbre #3 and assigned to selection button 3'2, but it is originally the one which is inherently associated with timbre #2.

The timbre-associated arpeggio type groups storing unit 11 stores, just like in the case of FIG. 6 (of prior art), arpeggio pattern data sets 71'1 through 71'N which are associated with the timbres, and also data representing the correspondence between the timbre numbers and the timbre names, data representing the correspondence between the arpeggio type numbers and the arpeggio type names, and so forth. The timbre-dependent available arpeggio type presenting unit 2*a* and the arpeggio type selecting unit 2*c* refer to the timbre-associated type groups storing unit 11 for the timbre names and the arpeggio type names using the timbre numbers and the arpeggio type numbers as retrieval keys, and obtain the timbre names and the arpeggio type names, and output the same to the display control unit 9 to display on the display device 10. The display control unit 9 controls the display device 10 to exhibit the arpeggio type selecting buttons 3'1 through 3'5 on the screen in different fashions according to the assignment conditions by the timbre-dependent available arpeggio type presenting unit 2*a*. Namely, the arpeggio type selecting buttons 3'1 through 3'5 are exhibited in different fashions depending on whether an arpeggio type is assigned or not.

The number of arpeggio type selecting buttons 3'1 through 3'5 is fixed in this embodiment. But the number and the kinds of available arpeggio types may vary from one timbre to another, or from one user to another. In any situations, it will be easy to recognize which of the arpeggio type selecting buttons are assigned with an arpeggio type. The display control unit 9 also controls the display conditions of the plural arpeggio type selecting buttons 3'1 through 3'5 depending on whether the button is manipulated (i.e. clicked) or not so that the user can easily tell the clicked one from other buttons.

When the user wants to change the number and the kinds of available arpeggio types, the user will manipulate an assignment registration change button 4. As the assignment registration change button 4 is manipulated, the timbre-dependent available arpeggio type presenting unit 2*a* changes arpeggio types which are to be made available according to the timbre designated by the timbre designating unit 1 and are to be assigned to the selection buttons, and rewrites the contents stored in the assignment registration unit 2*b*. When the user wants to change the assignment of the arpeggio types to the arpeggio type selecting buttons 3'1 through 3'5, the user manipulates the assignment registration change button 4. As the assignment registration change button 4 is manipulated, the timbre-dependent available arpeggio type presenting unit 2*a* changes arpeggio type selecting buttons to which arpeggio types to be made available according to the timbres designated by the timbre designating unit are to be assigned, and rewrites the contents stored in the assignment registration unit 2*b*. Examples of manipulations for changing the registration contents will be described in more detail with reference to FIGS. 3 and 5 herein below.

FIG. 3 is a chart depicting an example of the dialog-box or manipulating window displayed on the screen of the display device 10 of FIG. 1 for assigning and selecting arpeggio types. In FIG. 3, the like reference numerals are used to indicate the like elements in FIG. 1. The dialog-box may preferably be displayed on a touch sensitive type screen for direct touches with the finger of the user. Alternatively, the dialog-box may be an interactive window on a computer screen equipped in the apparatus. When the user designates a timbre, the user touches or clicks the button 1*a* on the dialog-box, and every touch (or click) calls the next timbre successively, and a timbre indicating box 22 exhibits the designated timbre name one after another successively in synchronism with the touching (or clicking) manipulation.

For every designated timbre, the arpeggio type selecting button 3'1 through 3'5 can be respectively assigned with arpeggio types made available. The arpeggio type selecting button 3'1 through 3'5 on the screen assume different indications (in color, or scale, or else) depending on whether an arpeggio type is assigned or not. For example, the arpeggio type selecting buttons 3'1 through 3'3 have a note symbol (of an eighth note) indicating that the buttons are assigned with an arpeggio type. When the user manipulates an arpeggio selecting button (e.g. #1), the available arpeggio type (e.g. #1) assigned to the manipulated button is selected. Then the selected button turns to assume the indication of "being selected" (e.g. reversed). In the example of FIG. 3, the selected button 3'1 is reversed (in color) so that the user can easily recognize the selected button 3'1.

While the above description is the case that the user manipulates the timbre designating control (button) 1*a* to designate a desired timbre, the timbre may be automatically designated according to the initial setting at the power-on of the apparatus. When a music performance data set is automatically played back using an arpeggiator, the timbre may be designated by the timbre designating data contained in the music performance data set. In the above described embodiment, the arpeggio type selecting unit 2*c* can select two or more arpeggio types concurrently by manipulating two or more arpeggio type selecting buttons 3'1 through 3'5 simultaneously. While each of the arpeggio type selecting buttons 3'1 through 3'5 is assigned with one arpeggio type in the above description. However, two or more arpeggio types may be assigned to one arpeggio type selecting button, so that one button manipulation selects two or more arpeggio types. In this last case, the resultant mixed types can be considered as a new arpeggio type. When two or more arpeggio types are selected, the arpeggio pattern data output unit 5 outputs the corresponding two or more arpeggio pattern data sets, and consequently mixed arpeggio performance tones are produced in the tone generator.

In the displayed dialog-box of FIG. 3, the arpeggio type indicating box 23 is to indicate the name of the selected arpeggio type. The arpeggio type indicating box 23 is prepared to indicate one arpeggio type name at a time, as it is supposed that only one arpeggio type will be selected usually, but in the case that the arpeggio type selecting unit 2*c* simultaneously receives selection commands from plural arpeggio type selecting buttons, the arpeggio type indicating box 23 exhibits one arpeggio type name on a last-in, first-priority basis.

At the power-on time or at the time the timbre is changed by the manipulation of the timbre designating switch 1*a*, a particular one arpeggio type may be selected according to the predetermined rule of the initial setting. For example, for each of the timbres, the arpeggio type which was assigned to the arpeggio type selecting button which was manipulated last time this timbre is designated may be selected as the initial condition from among one or more arpeggio types made available in association with this timbre, or alternatively, the arpeggio type which is assigned to the smallest numbered registration from among #1 through #5. When an arpeggio performance is started by manipulating an arpeggio performance start switch (not shown), the arpeggio type which is selected as the initial setting depending on the timbre now being designated will be used. Among a plurality of arpeggio types made available depending on the timbre and assigned to the arpeggio type selecting buttons, the arpeggio types which are assigned to the selecting buttons by the manipulation by the user will have a priority over those originally assigned to the selecting buttons at the time of product shipment from the factory. Where there are plural arpeggio types assigned by the user's altering manipulation, an arpeggio type will be used according to the predetermined priority rule from among them.

The above mentioned initial setting may be that at least one arpeggio type is randomly selected from among the available arpeggio types which are assigned to the arpeggio type selecting buttons 3'1 through 3'5. An arpeggio performance may be given some alterations automatically. The user may then manipulate a desired one of the arpeggio type selecting buttons 3'1 through 3'5 to switch over to a desired arpeggio type. For the random selection of an arpeggio type, a random function may be employed, for example, to obtain a random number, and a registration number may be determined accordingly from among the registration numbers #1 through #5 corresponding to the arpeggio type selection buttons 3'1 through 3'5 to which the available arpeggio types are assigned. Alternatively, a random number can be obtained from the current time indicated by the built-in clock.

The data representing the arpeggio types to be assigned and registered to the respective arpeggio type selecting buttons 3'1 through 3'5 in association with the timbers as shown in FIG. 2 may be rewritably stored or may be fixedly stored in the arpeggio type assignment registering unit 2*b* of FIG. 1. During a musical performance using a same timbre continuously, the arpeggio types will be switched over from one to another among the arpeggio types associated with the same timbre, and consequently no unnaturalness will be felt through such switched-over use. Further, such switched-over use of arpeggio types merely requires manipulating or clicking the desired one of the arpeggio type selecting buttons 3'1 through 3'5, which means that the arpeggio types can be changed easily and efficiently. The arpeggio types can be switched over smoothly in the midst of a music performance.

A method of selecting a timbre may be arbitrary, for example, a timbre can be selected by switching over the timbre name exhibited in the timbre indicating box 22 and touching the timbre selecting button la on the displayed dialog-box to successively call the next timbre candidate and determine a desired one. Alternatively, a drop-down list box may be exhibited below the timbre indicating box 22 and the user may select a desired one in the list box manipulating the timbre selecting button 1*a*. Further alternatively, the displayed dialog-box 21 may contain dialog-tabs each including associated arpeggio types, and the user may designate one of the dialog-tabs to select a desired one among the exhibited arpeggio types. In the illustrated example, the maximum number of registrable arpeggio types are five in quantity per timbre, but the number is not limited to five. Further, the number of arpeggio types are not necessarily be the same for all the timbres. For the piano timbre and guitar timbre, a relatively large number of arpeggio types are prepared and assigned, while for the timbre of organ or other musical instruments with sustaining tones, a relatively small number of arpeggio types are assigned. Some timbres may not have any associated arpeggio type, and no arpeggio types may be made available.

In the illustrated embodiment, a dialog-box displayed on a touch panel screen is used for the selection of the timbres and arpeggio types, but other kinds of selection system can be utilized. The selection buttons or controls may be bodies arranged on a control panel (not shown) rather than images on a screen 21. In place of a touch panel screen, an ordinary display screen may be used to exhibit the same dialog box 21 as explained above, but a cursor or a pointer on the screen may be moved to click the exhibited buttons using cursor keys or a mouse controller. Further alternatively, physical (body) buttons may be arranged on the control panel around the periphery of the display screen 10 and near the respective image buttons in the dialog-box 21 for the manipulation of the corresponding buttons. Further alternatively, numerals may be given to the image buttons in the dialog-box 21 and the user may type in a designating numeral by means of a numeric keyboard.

In the illustrated embodiment, the arpeggio type selecting buttons in the dialog-box 21 are exhibited with a note symbol and in a reversed condition to indicate the assigned and the selected condition. Any other visually distinctive indication may be utilized such as changing colors. In the case that separate arpeggio type selecting buttons 3'1 through 3'5 of a physical body buttons are arranged on a control panel other than the displayed dialog-box 21, the body buttons may be equipped with a light emitting diode or with a small display thereon, so that the conditions of availableness and assignment can be easily recognized. The state of indications are to be differentiated according to the states of assignment and of selection. While the dialog-box is common for the designation of timbre and for the selection of arpeggio type in the illustrated embodiment, separate windows may be prepared for those different purposes. Further, the method of selecting arpeggio types on the selection window directly from the overall presentation of arpeggio types as explained with reference to FIG. 6 may be employed in parallel.

FIG. 4 shows a block diagram illustrating the hardware configuration of an embodiment of an apparatus for providing arpeggio patterns according to the present invention. A description will be herein below made about how an arpeggio performance is conducted based on the arpeggio pattern data provided by an electronic musical apparatus as operated under a computer program according to the present invention.

In FIG. 4, a CPU (central processing unit) 32, a ROM (read-only memory) and a RAM (random-access memory) are connected via a bus 31. The RAM 34 provides working areas for the CPU 32. The ROM 33 stores programs for controlling the electronic musical apparatus, including a program to operate the CPU 32 for providing arpeggio patterns (pattern data files) and various preset data files or data pieces. Although not shown, a timer may also be equipped as in the conventional data processing apparatuses to be used for generating a tempo clock, an interrupt clock, or the like. The CPU 32 loads the program for controlling the electronic musical apparatus from the ROM 33 into the RAM 34 for various instantaneous data processing.

An input manipulation unit 35 includes a keyboard and control switches, buttons, tabs, knobs, etc. for playing music as well as making and adjusting various settings. According to key depressions (and releases), performance data including key depression time points, note numbers (pitches), key release time points, key depression speeds (velocities), etc. are obtained. Setting switches are for setting tone generation parameters including timbre designations and arpeggio performance parameters including arpeggio types (e.g. buttons shown in FIG. 3), and for setting conditions for recording and playing back song data files, and other control parameters.

Performance data files may be factory-stored in the ROM 33, or performance data files may be obtained by the user's actual playing of music pieces and stored in an external storage device 38. The performance data file will be loaded into the RAM 34 to play back a melody performance, while key manipulation data for arpeggio contained in the performance data file may be supplied to the arpeggio performance data producing unit 7.

A display circuit 36 is to supply image data to a display device 37 (10 in FIG. 1). The external storage device 38 may be a flash memory, an FDD (flexible disk drive), or the like storage device. An HDD (hard disk drive), a CD-ROM (compact disc read-only memory), an MO (magneto-optical) disk, a DVD (digital versatile disk), and other memory medium drives may also be utilized. The program for controlling an electronic musical apparatus and various data to be used for processing may be installed in a hard disk, which will be loaded into the RAM 34 for an actual operation of the apparatus.

A tone generator 39 is to generate tone signals, which in turn are supplied to a sound system (such as an amplifier and a loudspeaker). The CPU 32 processes the melody performance data from the keyboard in the input manipulation unit 35, the arpeggio performance data from the arpeggio performance data producing unit 7 and automatic rhythm performance data, etc., and supplies data representing start-up times of the tones (note-on), finish times of the tones (note-off), note pitches of the tones (note numbers), timbres of the tones, and other parameters for the tones, before supplying to the tone generator 39. The tone generator 39 receives the performance data and the associated tone parameters from the CPU 32 via the bus 31, synthesizes tone waveforms for the music performance, imparts necessary tone effects and supplies to the sound system 40 so that audible sounds will be emitted from the loudspeaker. The tone generator 39 may not necessarily be of a dedicated hardware structure, but may be constituted using a DSP (digital signal processor) or may be constituted by a software tone generator program executed by the CPU 32 to synthesize tone waveforms.

Connected to the bus 31 is one or more communication interfaces 41. A MIDI (musical instrument digital interface) interface can connect external apparatuses 42 such as an external tone generator device, a MIDI keyboard (input controls) to the bus 31. A general-purpose communication interface may be employed for connecting directly to the external apparatus, or for connecting to a remote server or a remote personal computer or else via a communication network such as a LAN (local area network) and Internet, so that performance data files can be inputted to or outputted from the apparatus, or a program for providing arpeggio patterns and various associated data to be processed can be downloaded.

The arpeggio type data to be assigned and registered to the arpeggio type selecting controls 3'1 through 3'5 in association with the designated timbre and the arpeggio pattern data files of the respective arpeggio types are originally stored in the ROM 33 or in the external storage device 38, and are loaded into the RAM 34 for the actual data processing.

Alternatively, the above-mentioned arpeggio type data to be assigned and registered to the arpeggio type selecting buttons 3'1 through 3'5 in association with the timbres or the arpeggio pattern data files may be included in the program for controlling the electronic musical apparatus. Further alternatively, the arpeggio pattern data may be composed with respect to each timbre based on predetermined rules. For the user to arbitrarily assign the desired arpeggio types to the arpeggio type selecting buttons 3'1 through 3'5, the arpeggio type names (or other information) which are assigned to the respective selecting buttons may be exhibited on the display window as grouped by timber and may be edited on the RAM 34, and the edited results may be stored in the external storage device 38. The arpeggio patterns can also be edited and stored.

FIGS. 5*a* and 5*b* show, in combination, a flow chart describing the operation of the apparatus for providing arpeggio patterns of FIG. 1, namely, the process steps for providing arpeggio patterns according to the present invention. The processes through steps S56, S64 and S65 (in FIG. 5*a*) are for the function of the arpeggio type directly selecting unit 6 of FIG. 1, while the processes through steps S55, S57 through S63 (in FIG. 5*b*) are for the function of providing arpeggio types in association with selection of the timbres.

A description will be made hereinbelow about the selection of arpeggio types assigned to the arpeggio type selecting controls or buttons 3'1 through 3'5 in association with the timbres, and about the alteration of the assignments of arpeggio types to the arpeggio type selecting controls 3'1 through 3'5. Steps which would not be necessary for the explanation of the above introduced processes will be omitted in the following.

A step S51 (FIG. 5*a*) displays a dialog-box (interactive window) 21 of FIG. 3 for selecting arpeggio types in association with timbres. The timbre indication box 22 indicates a default-set timbre or the last-used timbre (or a blank). A step S52 is to select a timbre. If the user wants to select another (or a new) timbre, the user will manipulate or touch the timbre designating button 1*a* successively until a desired timbre name appears in the indication box 22. The timbre designating unit 1 of FIG. 1 sends a signal designating the selected timbre to the timbre-dependent available arpeggio type presenting unit 2*a*. A step S53 detects the current arpeggio type as selected and indicated in the indication box 23 of FIG. 3. The indicated current arpeggio type may be a default-set one or the last-selected one from the arpeggio type selecting unit 2*c* or from the arpeggio type directly selecting unit 6 of FIG. 1 (or a blank). If the user calls another style of arpeggio type selection dialog-box (e.g. listing many arpeggio types), a step S54 judges YES and the process flow proceeds to a step S56. If not, the step S54 judges NO and the process flow goes to a step S55 (FIG. 5*b*).

The step S55 judges whether an arpeggio type selecting button is manipulated. If the judgment is affirmative (YES), the process moves forward to a step S57, and if the judgment is negative (NO), the process goes back to the step S51 (FIG. 5*a*). The step S57 turns the selected button, for example, the button 3'1 in FIG. 3, to an on-indication (reversed face) and turns the preceding selected button, if any, to an off-indication (normal face). The flow chart now describes the case in which only one arpeggio type is selected at a time where the system does not have a function of multiple selection at a time. A step S58 judges whether the selected button is already assigned to an arpeggio type. If the judgment is affirmative (YES), the process goes forward to a step S59 to update the contents of the data and the indication of the current arpeggio type in the indication box 23 by the arpeggio type assigned to the selected button, before proceeding to a step S60. If the button is not assigned with an arpeggio type, the process flow skips the step S59 and directly goes to the step S60.

The step S60 judges whether there is a manipulation as to change arpeggio types to be assigned to the selected button. When a button is in the selected state, and then the assignment registration button change 4 is manipulated, the process goes forward to a step S61, and if not, the process goes back to the step S51 (FIG. 5*a*). An example of operation of changing arpeggio types is like this. Among the arpeggio type selecting buttons 3'1 through 3'5, the arpeggio type selecting button in the selected state is detected, and the name of the arpeggio type is exhibited in the indication box 23. As the user once touches the assignment registration button 4, the system is turned into the registration change mode. After that, every time the user touches the assignment registration button 4, the arpeggio type name appearing in the indication box 23 is successively changed to the next one, thereby changing arpeggio types one after another to be made available in the timbre-dependent available arpeggio type presenting unit 2*a*. Alternatively, a drop-down list of arpeggio types may be exhibited from the arpeggio type indication box 23 upon touch on the assignment registration button 4, so that the user can select a desired one from the listed arpeggio types. Further alternatively, a separate menu box for arpeggio type registration may be utilized.

When the user wants to change the assignment states of the available arpeggio types to the arpeggio type selecting buttons 3'1 through 3'5, the assignment registration button 4 is to be manipulated. More particularly, if the user once touches the assignment registration button 4, the system is brought into the registration change mode. Then, if the user touches a button which is not in the selected state now, the touched button turns into the selected state and becomes the button to which the arpeggio type now being available is to be assigned.

The step S61 changes the arpeggio type to be assigned and registered to the selected button (the arpeggio type selecting button in the selected state), and the stored contents in the arpeggio type assignment registering unit 2*b* of FIG. 1 are rewritten by the assigned and registered condition. The name of the assigned and registered arpeggio type is exhibited in the indication box 23. In the case that the arpeggio types are administered by the groups of fives respectively corresponding to the five arpeggio type selecting buttons as shown in FIG. 2, the arpeggio type which is made available now is assigned and registered at the position of, for example, #1 which corresponds to the arpeggio type selecting button 3'1. A step 62 updates the currently selected arpeggio type including the indication at the box 23 and the output from the arpeggio type selecting unit 2*c* of FIG. 1. A step 63 turns the selected button to the assigned state indication, namely with a note symbol on it face before going back to the step S51.

The step S60 may be so modified that the change in arpeggio type be effected only when the "OK" button is manipulated in addition to the manipulation of the assignment registration change button 4. In case one of the buttons (arpeggio type selecting controls 3'1 through 3'5) shown in FIG. 3 should be set in the accepting state (selected state) at the initial state after the selection of the timbre, the judgments of the steps S55 and S60 would be conducted simultaneously, and if a manipulation for changing arpeggio types is detected, the process flow should proceed to the step S61. The processes of the steps S57 and 59 may then be conducted thereafter, if necessary. The arpeggio type which is once assigned and registered to the selected button can be changed to an unregistered state. In such a case, the step S61 is to assign an "unregistered" state to the selected button (manipulated arpeggio type selecting control), and change the arpeggio type of the table of FIG. 2 by entering a word "unregistered" at the corresponding registration number, and the step S63 turns the selected button to the "unregistered" state before going back to the step S51.

On the contrary, if a new arpeggio type should be assigned and registered to the registration number which is in the "unregistered" state, for example, #4 of the timbre #1, the user manipulates the button 3'4, and the step S55 detects the manipulation of the button #4 corresponding to the registration number 4 and the system is prepared for receiving designation for this button 3'4. And then, the step S60 detects the manipulation of the assignment registration change button 4. The step S50 assigns the new arpeggio type to the selected arpeggio type selecting button 3'4, and registers the new arpeggio type at the registration position #4 in the contents of the table of FIG. 2. The step S62 then updates the arpeggio type name exhibited in the box of currently selected arpeggio type, and the step S63 then turns the selected button (arpeggio type selecting control 3'4) to the "registered" state with a note symbol on its face.

On the other hand, when the step S54 (FIG. 5*a*) judges that there is a command of changing the displayed dialog-box of FIG. 3 to another window to call another style of arpeggio type selection such as the listing of a multiplicity of arpeggio types, the step S56 judges whether there is a command to call an arpeggio type selection dialog-box of a conventional style by the user manipulating a predetermined button on the control panel. If there is such a command, the process flow moves forward to a step S64, and if not, the process flow goes back to the start. A separate button to call such an arpeggio type selection dialog-box may be placed in the dialog-box 21 of FIG. 3. The step S64 judges whether there is a manipulation for selecting an arpeggio type, and if there is, the process flow goes forward to a step S65 to update the contents and the indication of the currently selected arpeggio type, before returning to the start. If there is no manipulation for selecting an arpeggio type, the process directly goes back to the start. The processing through the steps S54 and S56, and the processing through the steps S56, S64, S65 and S51 before coming back to the dialog-box for selecting arpeggio types involves several associated manipulations for changing related windows, but detailed description thereof is omitted here.

In the above description, the invention is applied to an electronic musical apparatus having a keyboard, but the invention may be applicable to other types of musical apparatuses such as a stringed instrument type, a wind instrument type and a percussion instrument type. The electronic musical apparatus of the described embodiment may be configured as a system by interconnecting separate devices such as a keyboard and other input manipulation device, a tone generator device and so forth by means of a dedicated MIDI interface and various communication network interfaces, in place of the described electronic musical apparatus incorporating a built-in keyboard and input controls and a built-in tone generator. Alternatively, a computer program to execute the processing steps as described above may be installed in a personal computer to realize an arpeggio pattern providing system according to the present invention. A MIDI keyboard may preferable be connected via a MIDI interface to provide a musical keyboard. The present invention is applicable not only to an electronic musical apparatus and a personal computer, but also to a karaoke apparatus, a game machine, a portable terminal such as a cell phone, a player piano, and so forth.

As will be apparent from the above description, the present invention is advantageous over the conventional apparatus in that one or more arpeggio types are made available with respect to at least one timbres at the time of performing arpeggios. Further, among plural arpeggio types which are made available, the manipulation for the selection of arpeggio types is easy and efficient.

While particular embodiments of the invention and particular modifications have been described, it will, of course, be understood by those skilled in the art that various modifications and substitutions may be made without departing from the spirit of the present invention so that the invention is not limited thereto, since further modifications may be made by those skilled in the art, particularly in light of the foregoing teachings. It is therefore contemplated by the appended claims to cover any such modifications that incorporate those features of these improvements in the true spirit and scope of the invention.

What is claimed is:

1. An apparatus for providing arpeggio patterns comprising:

a timbre designating device which designates a timbre in which arpeggio notes are to be sounded;

a timbre-dependent arpeggio type output device which presents one or more available arpeggio types depending on the timbre designated by said timbre designating device, wherein a plurality of arpeggio types are made available with respect to at least one timbres designated by said timbre designating device, and at least one arpeggio types are outputted from among said plurality of arpeggio types; and an arpeggio pattern data output device which outputs arpeggio pattern data of said arpeggio types outputted by said timbre-dependent arpeggio type output device.

2. An apparatus as claimed in claim 1, wherein said arpeggio types are prepared in association with timbres, and said timbre-dependent arpeggio type output device presents part or all of said one or more arpeggio types prepared in association with the timbres depending on the timbre designated by said timbre designating device.

3. An apparatus as claimed in claim 1, wherein:

said timbre-dependent arpeggio type output device includes a timbre-dependent available arpeggio type presenting device and an arpeggio type selecting device;

said timbre-dependent arpeggio type presenting device is to present one or more available arpeggio types depending on the timbre as designated by said timbre designating device, wherein a plurality of arpeggio types are made available per timbre with respect to at least one of the timbres as designated by said timbre designating device, and to assign said one or more available arpeggio types respectively to one or more arpeggio type selecting controls; and said arpeggio type selecting device is to select, in response to manipulation of one of said one or more arpeggio type selecting controls and by means of said timbre-dependent available arpeggio type presenting device, an available arpeggio type which is assigned to said manipulated one of said selecting controls, and to output the selected arpeggio type.

4. An apparatus as claimed in claim 3, further comprising a display device and a display control device, said display control device controlling said display device to display said arpeggio type selecting controls on said display device in such a way that the arpeggio type selecting controls to each of which an available arpeggio type is assigned and the arpeggio type selecting controls to each of which an available arpeggio type is not assigned are displayed in different fashions.

5. An apparatus as claimed in claim 3, further comprising a display device and a display control device, said display control device controlling said display device to display said arpeggio type selecting controls on said display device in such a way that the manipulated one of said arpeggio type selecting controls and the non-manipulated ones of said arpeggio type selecting controls are displayed in different fashions.

6. An apparatus as claimed in claim 4, wherein said display control device further controls said display device to display said arpeggio type selecting controls on said display device in such a way that the manipulated one of said arpeggio type selecting controls and the non-manipulated ones of said arpeggio type selecting controls are displayed in different fashions.

7. An apparatus as claimed in claim 3, wherein said arpeggio type selecting device selects and outputs an initial default arpeggio type by randomly selecting one from among the available arpeggio types presented by said timbre-dependent available arpeggio type presenting device with respect to said at least one timbres designated by said timbre designating device.

8. An apparatus as claimed in claim 3, wherein said timbre-dependent available arpeggio type presenting device alters available arpeggio types as presented in association with the timbre designated by said timbre designating device, according to the manipulation by the user for altering the designation of the timbre.

9. An apparatus as claimed in claim 3, wherein said timbre-dependent available arpeggio type presenting device alters assignment of the available arpeggio types in association with the timbre as designated by said timbre designating device to the respective arpeggio type selecting controls, according to the manipulation by the user for altering the assignment of the available arpeggio types.

10. A computer-readable storage medium storing a computer program for providing arpeggio patterns the computer program containing:

a timbre designating code for designating a timbre in which arpeggio notes are to be sounded;

a timbre-dependent arpeggio type outputting code for presenting one or more available arpeggio types depending on the timbre designated by said timbre designating code, wherein a plurality of arpeggio types are made available with respect to at least one timbres designated by said timbre designating code, and for outputting at least one arpeggio types from among said plurality of arpeggio types; and an arpeggio pattern data outputting code for outputting arpeggio pattern data of said arpeggio types outputted by said timbre-dependent arpeggio type outputting code.

11. A method of providing arpeggio patterns comprising:

a timbre designating step of designating a timbre in which arpeggio notes are to be sounded;

a timbre-dependent arpeggio type outputting step of presenting one or more available arpeggio types depending on the timbre designated by said timbre designating step, wherein a plurality of arpeggio types are made available with respect to at least one timbres designated by said timbre designating step, and for outputting at least one arpeggio types from among said plurality of arpeggio types; and an arpeggio pattern data outputting step for outputting arpeggio pattern data of said arpeggio types outputted by said timbre-dependent arpeggio type outputting step.

* * * * *